US006655292B1

(12) United States Patent
Salzeder

(10) Patent No.: US 6,655,292 B1
(45) Date of Patent: Dec. 2, 2003

(54) CAMOUFLAGE MEANS AND CAMOUFLAGE PROCEDURES

(75) Inventor: Rudolf Salzeder, Piding (DE)

(73) Assignee: Buck Werke GmbH & Co., Bad Uberkingen (DE)

( * ) Notice: Subject to any disclaimer, the term of this patent is extended or adjusted under 35 U.S.C. 154(b) by 600 days.

(21) Appl. No.: 09/018,790

(22) Filed: Feb. 4, 1998

(30) Foreign Application Priority Data

Feb. 4, 1997 (DE) ..... 197 04 070

(51) Int. Cl.[7] ..... F42B 12/48
(52) U.S. Cl. ..... 102/334; 102/370; 102/505
(58) Field of Search ..... 102/334, 505, 102/370, 367; 89/1.11

(56) References Cited

U.S. PATENT DOCUMENTS 3,626,415 A * 12/1971 Montgomery ..... 102/505
3,713,383 A * 1/1973 Crescenzo et al. ..... 102/367
3,759,216 A * 9/1973 Sanders et al. ..... 102/334 X
3,833,064 A * 9/1974 Ranney, Jr. ..... 102/367 X
4,391,197 A * 7/1983 Jacobsen et al. ..... 102/367 X
4,471,683 A * 9/1984 Brown ..... 89/1.11
4,505,441 A * 3/1985 Kirsch et al. ..... 89/1.11 X
4,704,942 A * 11/1987 Barditch ..... 89/1.11 X
4,738,411 A * 4/1988 Ahlstrom et al. ..... 89/1.11 X
4,899,662 A * 2/1990 Santalucia et al. ..... 102/505
4,938,144 A * 7/1990 Demarest ..... 102/334
5,411,225 A * 5/1995 Lannon et al. ..... 102/505 X
5,577,431 A * 11/1996 Kusters ..... 89/1.11 X

FOREIGN PATENT DOCUMENTS

GB 2018404 * 10/1979 ..... 102/334

* cited by examiner

*Primary Examiner*—Peter A. Nelson
(74) *Attorney, Agent, or Firm*—Burns, Doane, Swecker & Mathis, LLP

(57) ABSTRACT

A camouflage device includes at least one releasable active material disposed in at least one container to interrupt a line of sight, whereby the container can be deployed as a preventive measure and the active material can be remotely activated, if necessary. The container(s) can be brought to the desired location to be off-loaded by a transport vehicle, such as a truck.

7 Claims, 2 Drawing Sheets

CAMOUFLAGE MEANS AND CAMOUFLAGE PROCEDURES

BACKGROUND OF THE INVENTION

The invention concerns a camouflage means, including at least one releasable active material in at least one container to interrupt the line of sight, as well as a camouflage procedure to use this camouflage means.

In general a means of camouflage serves to disrupt the line of sight between a sensor and a target for military purposes. Modern sensors for reconnaissance, target acquisition, target tracking, weapon employment and weapon effects analysis thereby use the following areas of the electromagnetic spectrum:

Ultraviolet range (UV range) to exploit the fluorescence effect among other things, Visible range (VIS range) for the human observer as well as optical reconnaissance and targeting devices, Low, middle and high infra-red range (IR range) for laser, image and residual light amplifiers, active infra-red devices and heat imaging devices, and Radar range, primarily I, I/J and J bands for battlefield radars as well as I/J and K band for ground-air radars.

The following table shows the electromagnetic spectrum that is used for military purposes.

ELECTROMAGNETIC SPECTRUM
(Range Used for Military Purposes)

| UV (um) | Visible (um) | Infra-red (um) | Radar |
|---|---|---|---|
| .3–.4 | .4–.7 | .7–2.5<br>3–5<br>8–14 | Ground–ground 75% I, J, I/J band 1.93–3,53 cm, 8.7–17 GHz 10% F portion Ground–air 44% I, J, I/J band, 1.91–3.53 cm, 8.7–17.7 GHz 17% K band .83–.9 cm, 33.4–36 GHz 13% E, F, E/F band 7.49–13 cm, 2.3–4 GHz 13% G portion, 5.06–5.43 cm, 5.25–5.49 GHz 7% H band, 3.75–5 cm, 6–8 GHz |

The combat power of the opponent on the modern battlefield can be significantly reduced, if success can be attained in not allowing hostile reconnaissance, target acquisition, target tracking and weapon guidance sensors to be effectively coordinated with the combat activities of the combat forces or to significantly affect their employment capabilities in an adverse manner. Known means are camouflage smoke which is effective in the UV, visible and/or IR ranges and chaff clouds, including electrically conducting fibers, like tin foil strips and chaff, which are suited to shroud the radar range.

It is basically possible to emplace by means of artillery or aircraft a large area smoke wall and/or many chaff clouds that form a wall. In the case of emplacement by means of artillery, coordination with ground forces is possible to be sure, but there results an intolerable endangerment of friendly forces from the falling round cases and active material containers, since the smoke and/or chaff clouds must also be emplaced on friendly territory. In addition, new rounds or rockets for the active material must be developed for the artillery that enable the active material to sway on a parachute and which will require a lot of technical effort or at least be costly, or drones can be employed, whereby the cargo area is probably too small for large area line of sight disruption or camouflage and a short term solution, especially for chaff dispensing, is not possible. The use of drones like the use of aircraft also, on the one hand, requires the dropping of the active material on parachutes and, on the other hand, coordination of the employment with combat troops can only be achieved with great difficulty for reasons of air-space management and timely availability. Finally, the use of vehicle-mounted smoke generators which have been introduced by many NATO partners is also possible; they: (a) provide a long-lasting smoke cloud, but until now only an infra-red smoke cloud, (b) enable the use of chaff but only in limited numbers, and can only be employed in a preplanned manner which makes coordination with the use of combat forces problematic. The use of vehicle-mounted smoke generators is also costly, since the vehicle are special and special personnel.

The task of this invention is therefore to overcome the disadvantages of the state of technology, i.e., to make available a camouflage means and a camouflage procedure by means of which: (a) at least a portion of the line of sight of hostile modern sensors for reconnaissance, target acquisition, target tracking, and weapon guidance can be taken away, (b) a time and space coordination with friendly forces can be facilitated, and (c) no special personnel or operational vehicles are required so costs can be saved.

SUMMARY OF THE INVENTION

A camouflage means of the type to solve the task of this invention is thereby characterized by the container being able to be moved when required and the active material being capable of remote activation.

A preferred embodiment of the invention is thereby characterized by the camouflage means including at least one pyrotechnical smoke generator to produce at least one smoke cloud for the purpose of line of sight disruption in the UV, visible and/or IR ranges.

The smoke generator can thereby incorporate a smoke pot.

The camouflage means in the invention can also incorporate at least one chaff dispenser to produce at least one chaff cloud for the purpose of disrupting the line of sight in the radar range.

The invention also proposes, that the container be equipped with an antenna for remote activation by radio, that the container incorporate a trigger for immediate activation, and/or that the container be equipped with a tripod, preferably folding, and/or ground spikes.

The invention provides for the container being able to float or that the container is capable of being anchored on the battlefield.

It is further preferred in the invention, that the container manifest an initial code by means of which it can be controlled.

The container of the invention can contain the active material in the form of several sub-munitions which are preferably ignitable individually or in groups and/or a second code by means of which it can be precisely controlled.

The invention also proposes that several containers can be connected to each other.

A camouflage procedure which uses the camouflage means of the invention to solve the task posed for the invention is thereby characterized by the container being brought to the desired location by a transport vehicle, like a truck, and there off- loaded.

The container can either be thrown off or erected.

If the container is not used, it can either be retrieved or undergo emergency destruction, if necessary.

Finally, the invention prefers, that several smoke generators and/or chaff dispensers be distributed across a battlefield and ignited either individually or by groups in coordination with combat forces and depending on the weather conditions.

Underlying the invention is the surprising knowledge, that the battlefield can be disrupted by pyrotechnical smoke generators and/or chaff dispensers which are preplanned in probable battle areas, even in the weapons effect coverage area of hostile weapons and in watery areas, and that are distributed by transport vehicles and activated, when required, by remote control. The appropriate active materials, depending on the tactics to be used in either the UV, visible and/or IR range with smoke and/or in the radar range by radar reactive chaff, are able to be coordinated with combat units because of the provision of remote control. The invention also makes possible the staggered individual or group activation of several sub-munitions of one active material container and/or active material containers, whereby the coordination with combat forces is improved and consideration of the weather conditions is made possible.

Finally the camouflage means of this invention involves a bulk consumable good of reasonable cost which can be used by all units without special personnel or operational vehicles and which can be retrieved after non-use or undergo emergency destruction by remote control, if necessary.

BRIEF DESCRIPTION OF THE DRAWING

Other features and advantages of the invention can be seen in more detail in the following description of preferred embodiments of the invention depicted in the schematic drawings. Shown FIG. 1*a*—A view in perspective of the smoke generator of the invention, FIG. 1*b*—A view in perspective of the chaff dispenser of the invention, FIG. 2—A view to illustrate the throwing of a smoke generator off a transport truck, FIG. 3—A view to illustrate the throwing of several smoke generators in a possible battle area, FIG. 4—A view to illustrate the production by remote initiation of a smoke screen in a battle area, and FIG. 5—A view to illustrate the production by remote initiation of a chaff cloud in a battle area.

DETAILED DESCRIPTION OF PREFERRED EMBODIMENTS OF THE INVENTION

Figure 1A:
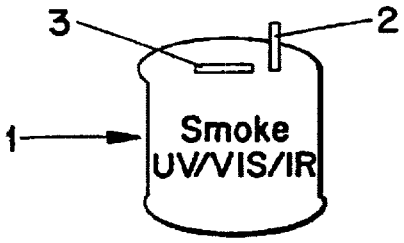

As can be seen in FIG. 1*a* a smoke generator of the invention includes a smoke pot 1 to house an active material, an antenna 2 for remote activation and a trigger 3 for immediate activation.

Figure 1B:
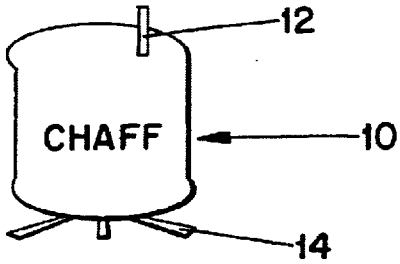

A chaff dispenser of the invention, on the other hand, includes, as can be seen in FIG. 1*b*, a launcher bowl 10 for the active material, an antenna 12 for remote activation and a folding tripod 14 for erection on the ground.

The actual active material is thereby assembled in shape, size and material according to the desired spectrum for line of sight disruption. The larger the spectral area to be covered, the larger the range of particles to be used as well as their amount, size and density.

If, for example, a disruption is to be caused in the visible, IR and radar ranges, the following must be taken into consideration for the active material used:

As can be extracted from the table, the infra-red range to be covered surpasses the visible range by a multiple, so that a number of different particle sizes will be needed. Since particles of appropriate size which are effective in different wavelengths must each be available in sufficient quantities, it is only possible to achieve the desired effect under favorable conditions in the three militarily-related IR ranges listed in the table by using the same amount of active material as is used in the visible range. A satisfactory effect can be achieved in these IR ranges using the active material which can be employed due to the small particle size and which also has a smoke character on the other side of the visible range and whose chemical characteristics can use the humidity in the air in a positive way. An increase in the amount of active material to be employed, however, is often necessary. The amount of active material required in the IR range depends thereby basically on the temperature contrast between the target and the background. That differs greatly, especially depending on the season and time of day, the weather conditions, the self-produced energy of the target, and the distances between the sensor and the target, so that with very low contrasts the amount of active material which is the same as for the visible range can be sufficient, but with very high contrasts multiple amounts of the active material may be necessary.

The bands to be covered in the radar range encompass wavelengths that differ greatly from the particle sizes of smoke active materials, so that the use of dipole active material, like chaff, is required. These must be so spaced out in cocktail compositions, that they cause the desired disruption effect in radar sondes. Chaff active material can not climb upward like smoke active material, but instead requires aerial dispersion.

It is generally true that the disruption of a multi-spectral line of sight depends primarily on placing the correct particle mix in a sufficient amount at the desired location on the target according to the weather and to so distribute it there, that the desired effect is achieved at the desired time.

Figure 2:
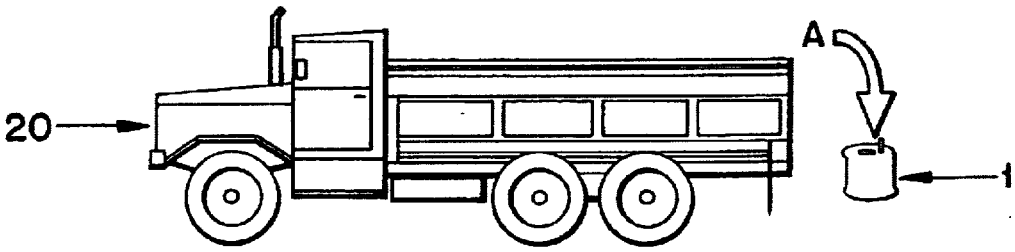
Figure 3:
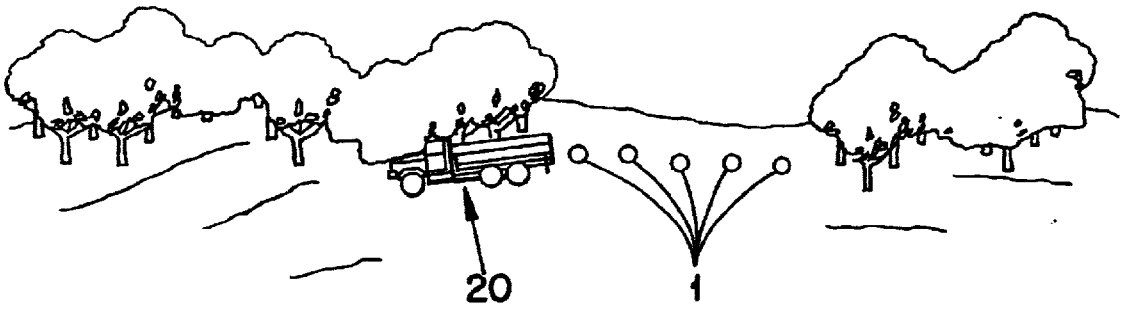

The smoke pots 1 or launcher bowls 10 of the invention can, for example, be brought to the desired location in the battle area by a truck 20 and unloaded there. In the case of smoke pots 1, that can be done by throwing, as shown by the arrow A in FIG. 2, while in the case of launcher bowls 10 erection of the tripod 14 is necessary, in order to facilitate the firing of the chaff active material into the air. In the process a number of smoke pots 1, as shown in FIG. 3, and/or launcher bowls 10 can be dispersed by truck 20 at any desired time prior to the use of the active material.

Figure 4:
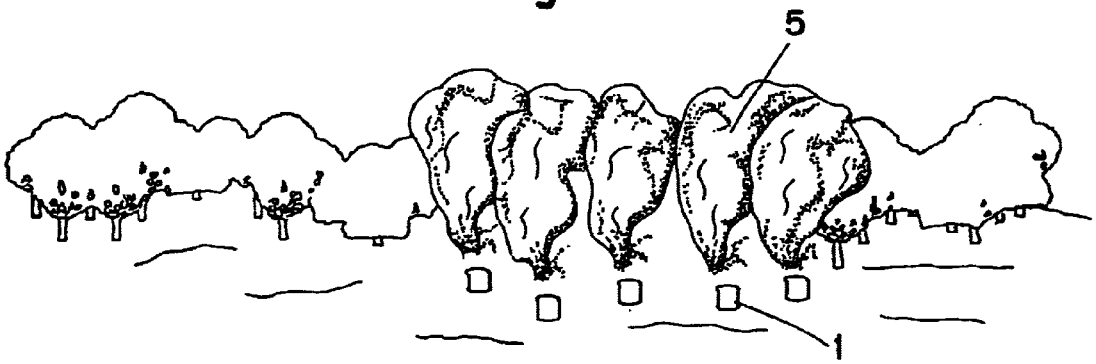
Figure 5:
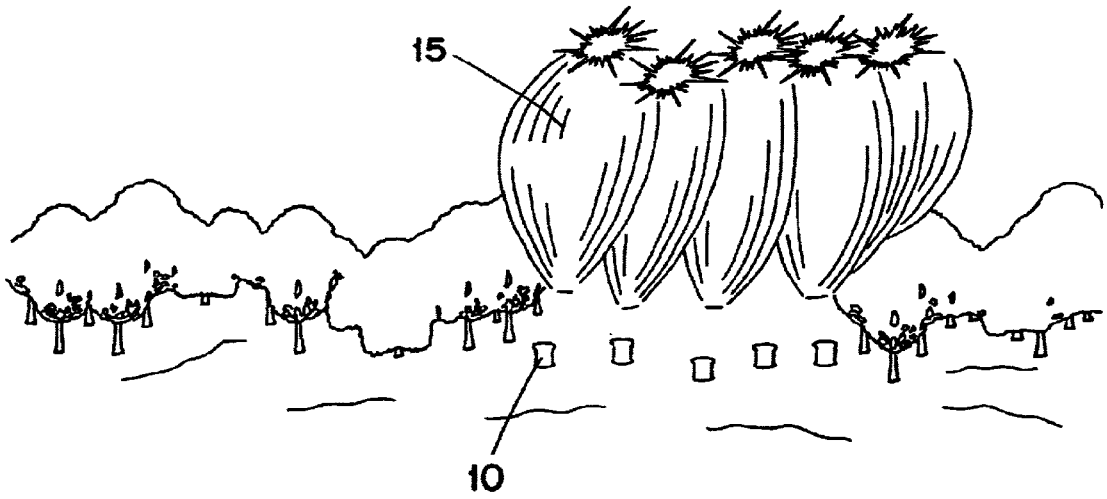

In the event of combat the smoke pots 1 can then be remotely activated by means of the antenna 2 to produce smoke clouds 5, as shown in FIG. 4, or the launcher bowls 10 by means of the antenna 12 to produce chaff clouds 15, as shown in FIG. 5, for the purpose of large area disruption or for the purpose of camouflage. In the process it is thereby possible to precisely control by means of coding either individual, or groups of, smoke pots 1 and/or launcher bowls 10 as well as their sub-munitions for the purpose of coordination with the combat forces and to take weather conditions into account.

The launcher bowls 10 are so shaped, that the chaff active material can be dispersed in the air in order to then slowly sink back to the ground, whereby a height of 50 m is sufficient to achieve a satisfactorily long suspension time for the chaff clouds 5.

For customary IR active measures ten smoke pots 1, for example with a diameter of about 20 cm, a height of about 20 cm, and a weight of about 10 kg, can be so deployed, that a 100 m long smoke cloud can be maintained for a smoke duration of at least 10 minutes with a wind speed of about 3 m per minute.

The smoke pots 1 and/or the launcher bowls 10 can be manufactured to float in order to camouflage river crossings, so that several smoke pots 1 and/or launcher bowls 10 connected by a rope can be pulled across the water upstream or downstream, be anchored on the bank, and be remotely activated when needed.

The advantages of the smoke pots 1 and/or launcher bowls 10 of the invention are:

- They can be deployed as a preventive measure, depending on the evaluation of the situation;
- Their use can be coordinated with combat forces because of the remote control capability without which they endanger friendly forces;
- By preplanned deployment their use is possible in the effective area of hostile weapons;
- By emplacement of several smoke pots 1 and/or launcher bowls 10 at one location and by activation at time intervals a camouflage of desired duration and dimensions can be set;
- The smoke pots 1 and/or launcher bowls 10 of the invention involve bulk consumable goods at a favorable cost;
- The smoke pots 1 and/or launcher bowls 10 of the invention are suited for use by all forces and do not require special personnel or operational vehicles; and
- The smoke pots 1 and/or launcher bowls 10 of the invention can be retrieved when not used, if desired, or can undergo emergency detonation by remote control.

In addition the camouflage spectrum can be set by means of an appropriate amount of active material for the visible and IR to radar ranges.

The characteristics of the invention explained in the foregoing description, the drawings, and the claims can be essential, either individually or in any desired combination, for the realization of the invention in its various execution models.

REFERENCE LIST

1 Smoke pot
2 Antenna
3 Trigger for immediate activation
5 Smoke cloud
10 Launcher bowl
12 Antenna
14 Tripod
15 Chaff cloud
20 Truck

What is claimed is:

1. A method of deploying and activating a camouflage device comprising at least one container, the container including at least one releasable active material to interrupt a line of sight, a remotely controllable activator disposed in the container for activating the active material in response to a coded remote control radio signal, the method comprising off-loading the container to a deployment site from a land transport vehicle in a non-activated state, and thereafter providing the activator with a coded radio signal from a location remote from the deployment site with the container at rest, to activate and release the active material at a location where the container is situated when the coded radio signal is received by the activator.

2. The method according to claim 1, wherein the off-loading step comprising throwing the container off the land transport vehicle.

3. The method according to claims 1, wherein the off-loading step comprises removing the container from the truck and erecting a ground support for the container.

4. The method according to claim 1, further including retrieving the container if not used.

5. The method according to claim 1, wherein the at least one container comprises several containers, the method including activating the containers individually in a sequence.

6. The method according to claim 1, wherein the at least one container comprises several containers activated in groups.

7. The method according to claim 1 wherein the at least one container comprises several containers, the activators of respective containers being responsive to different codes, the method including initially transmitting a code for activating some but not all of the containers.

* * * * *